US011664595B1

(12) United States Patent
Wong et al.

(10) Patent No.: US 11,664,595 B1
(45) Date of Patent: May 30, 2023

(54) INTEGRATED WIDEBAND ANTENNA

(71) Applicant: INDUSTRIAL TECHNOLOGY RESEARCH INSTITUTE, Hsinchu (TW)

(72) Inventors: Kin-Lu Wong, Kaohsiung (TW); Wei-Yu Li, Yilan (TW); Wei Chung, Hengshan Township (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 34 days.

(21) Appl. No.: 17/551,617

(22) Filed: Dec. 15, 2021

(51) Int. Cl.
*H01Q 5/50* (2015.01)
*H01Q 13/10* (2006.01)

(52) U.S. Cl.
CPC ..... *H01Q 5/50* (2015.01); *H01Q 13/10* (2013.01)

(58) Field of Classification Search
CPC ..... H01Q 5/50; H01Q 13/10
See application file for complete search history.

(56) References Cited

U.S. PATENT DOCUMENTS 4,460,899 A 7/1984 Schmidt et al.
5,952,983 A 9/1999 Dearnley et al.
(Continued)

FOREIGN PATENT DOCUMENTS

CN 104882672 A 9/2015
CN 105932409 B 9/2016
(Continued)

OTHER PUBLICATIONS

TW Office Action in Application No. 110146949 dated Jan. 7, 2023.
(Continued)

*Primary Examiner* — Dieu Hien T Duong
(74) *Attorney, Agent, or Firm* — Maschoff Brennan

(57) ABSTRACT

The disclosure provides an integrated wideband antenna, comprising a first conductor layer, a first conductor patch, a second conductor patch, a feeding conductor structure and a signal source. The first conductor patch has a first coupling edge and a first connecting edge. The first connecting edge electrically connects with the first conductor layer through a first shorting structure. The second conductor patch has a second coupling edge and a second connecting edge. The second connecting edge electrically connects with the first conductor layer through a second shorting structure. The second coupling edge is spaced apart from the first coupling edge at a third interval forming a resonant open slot. The feeding conductor structure is located within the resonant open slot and has a first conductor line, a second conductor line and a third conductor line. The first conductor line is spaced apart from the first coupling edge with a first coupling interval. The second conductor line is spaced apart from the second coupling edge with a second coupling interval. The third conductor line electrically connects the first conductor line and the second conductor line. The signal source is electrically coupled to the feeding conductor structure. The signal source excites the integrated wideband antenna to generate one multi-resonance mode covering at least one first communication band.

[REPRESENTATIVE FIGURE]: FIG. 1A

Simple Symbolic Explanation of the Representative Figure
1: integrated wideband antenna
11: first conductor layer
12: first conductor patch
121: first coupling edge
122: first connecting edge
123: first shorting structure
13: second conductor patch
131: second coupling edge
132: second connecting edge
(Continued)

133: second shorting structure
14: resonant open slot
15: feeding conductor structure
151: first conductor line
152: second conductor line
153: third conductor line
16: signal source
d1: first interval
d2: second interval
d3: third interval
s1: first coupling interval
s2: second coupling interval Characteristic Chemical Formula
NONE

18 Claims, 8 Drawing Sheets

(56) References Cited

U.S. PATENT DOCUMENTS

| | | | |
|---|---|---|---|
| 5,990,838 | A | 11/1999 | Burns et al. |
| 6,104,348 | A | 8/2000 | Karlsson et al. |
| 6,288,679 | B1 | 9/2001 | Fischer et al. |
| 6,344,829 | B1 | 2/2002 | Lee |
| 6,426,723 | B1 | 7/2002 | Smith et al. |
| 6,518,930 | B2 | 2/2003 | Itoh et al. |
| 7,250,910 | B2 | 7/2007 | Yoshikawa et al. |
| 7,271,777 | B2 | 9/2007 | Yuanzhu |
| 7,330,156 | B2 | 2/2008 | Arkko et al. |
| 7,352,328 | B2 | 4/2008 | Moon et al. |
| 7,385,563 | B2 | 6/2008 | Bishop |
| 7,405,699 | B2 | 7/2008 | Qin |
| 7,460,069 | B2 | 12/2008 | Park et al. |
| 7,498,997 | B2 | 3/2009 | Moon et al. |
| 7,541,988 | B2 | 6/2009 | Sanelli et al. |
| 7,561,110 | B2 | 7/2009 | Chen |
| 7,573,433 | B2 | 8/2009 | Qin |
| 7,586,445 | B2 | 9/2009 | Qin et al. |
| 7,609,221 | B2 | 10/2009 | Chung et al. |
| 7,688,273 | B2 | 3/2010 | Montgomery et al. |
| 7,710,343 | B2 | 5/2010 | Chiu et al. |
| 7,714,789 | B2 | 5/2010 | Tsai et al. |
| 7,733,285 | B2 | 6/2010 | Gainey et al. |
| 10,103,445 | B1 | 10/2018 | Gregoire et al. |
| 2009/0322639 | A1 | 12/2009 | Lai |
| 2010/0134377 | A1 | 6/2010 | Tsai et al. |
| 2010/0156745 | A1 | 6/2010 | Andrenko et al. |
| 2010/0156747 | A1 | 6/2010 | Montgomery |
| 2010/0238079 | A1 | 9/2010 | Ayatollahi et al. |
| 2010/0295736 | A1 | 11/2010 | Su |
| 2010/0295750 | A1 | 11/2010 | See et al. |
| 2021/0013620 | A1* | 1/2021 | Hung ..... H01Q 9/0457 |

FOREIGN PATENT DOCUMENTS

| | | | |
|---|---|---|---|
| CN | 106887690 | B | 6/2017 |
| TW | 201019528 | A | 5/2010 |
| TW | M529948 | U | 10/2016 |
| TW | 201639240 | A | 11/2016 |
| TW | 202121747 | A | 6/2021 |

OTHER PUBLICATIONS

Peng Gao et al., A Compact UWB and Bluetooth Slot Antenna for MIMO/Diversity Applications, ETRI Journal, vol. 36, No. 2, Apr. 2014, pp. 309-312.
Qingyuan Liu et al., A Compact Wideband Planar Diversity Antenna for Mobile Handsets, Microwave and Optical technology Letters, vol. 50, No. 1, Jan. 2008, pp. 87-91.
Shin-Chang Chen et al., A Decoupling Technique for Increasing the Port Isolation Between Two Strongly Coupled Antennas, IEEE Transactions on Antennas and Propagation, vol. 56, No. 12, Dec. 2008, pp. 3650-3658.
Yuan Ding et al., A Novel Dual-Band Printed Diversity Antenna for Mobile Terminals, IEEE Transactions on Antennas and Propagation, vol. 55, No. 7, Jul. 2007, pp. 2088-2096.
Yaxing Cai et al., A Novel Wideband Diversity Antenna for Mobile Handsets, Microwave and Optical Technology Letters / vol. 51, No. 1, Jan. 2009, pp. 218-222.
Jung-Min Kim et al., A Parallel-Plate-Mode Suppressed Meander Slot Antenna With Plated-Through-Holes, IEEE Antennas and Wireless Propagation Letters, vol. 4, 2005.
Saou-Wen Su, A Three-In-One Diversity Antenna System for 5 GHz WLAN Applications, Microwave and Optical Technology Letters / vol. 51, No. 10, Oct. 2009, pp. 2477-2481.
Mohammad S. Sharawi et al., A Two Concentric Slot Loop Based Connected Array MIMO Antenna System for 4G/5G Terminals, IEEE Transactions On Antennas and Propagation, vol. 65, No. 12, Dec. 2017, pp. 6679-6686.
Da Qing Liu, et al., An Extremely Low-Profile Wideband MIMO Antenna for 5G Smartphones, IEEE Transactions on Antennas and Propagation, vol. 67, No. 9, Sep. 2019, pp. 5772-5780.
Yan-Yan Liu et al., Compact Differential Band-Notched Stepped-Slot UWB-MIMO Antenna With Common-Mode Suppression, IEEE Antennas and Wireless Propagation Letters, vol. 16, 2017, pp. 593-596.
Gunjan Srivastava et al., Compact MIMO Slot Antenna for UWB Applications, IEEE Antennas and Wireless Propagation Letters, vol. 15, 2016, pp. 1057-1060.
Hongpyo Bae et al., Compact Mobile Handset MIMO Antenna for LTE700 Applications, Microwave and Optical Technology Letters / vol. 52, No. 11, Nov. 2010, pp. 2419-2422.
J.C. Coaetzee et al., Compact Multiport Antenna with Isolated Ports, Microwave and Optical Technology Letters / vol. 50, No. 1, Jan. 2006, pp. 229-232.
Le Kang, Compact Offset Microstrip-Fed MIMO Antenna for Band-Notched UWB Applications, IEEE Antennas and Wireless Propagation Letters, vol. 14, 2015, pp. 1754-1757.
Peng Gao et al., Compact Printed UWB Diversity Slot Antenna With 5.5-GHz Band-Notched Characteristics, IEEE Antennas and Wireless Propagation Letters, vol. 13, 2014, pp. 376-379.
Saou-Wen Su, Concurrent Dual-Band Six-Loop-Antenna System with Wide 3-dB Beamwidth Radiation for MIMO Access Points, Microwave and Optical Technology Letters / vol. 52, No. 6, Jun. 2010, pp. 1253-1258.
Dongho Kim et al., Design of a Dual-Band MIMO Antenna for Mobile WiMAX Application, Microwave and Optical Technology Letters / vol. 53, No. 2, Feb. 2011, pp. 410-414.
M. Faisal Abedin, et al., Effects of EBG Reflection Phase Profiles on the Input Impedance and Bandwidth of Ultrathin Directional Dipoles, IEEE Transactions on Antennas and Propagation, vol. 53, No. 11, Nov. 2005, pp. 3664-3672.
Kasra Payandehjoo et al., Employing EBG Structures in Multiantenna Systems for Improving Isolation and Diversity Gain, IEEE Antennas and Wireless Propagation Letters, vol. 8, 2009, pp. 1162-1165.
Jui-Hung Chou et al., Internal Wideband Monopole Antenna for MIMO Access-Point Applications in the WLAN/WiMAX Bands, Microwave and Optical Technology Letters / vol. 50, No. 5, May 2008, pp. 1146-1148.
Julien Sarrazin et al., Investigation on Cavity/Slot Antennas for Diversity and MIMO Systems: The Example of a Three-Port Antenna, IEEE Antennas and Wireless Propagation Letters, vol. 7, 2008, pp. 414-417.
Chao-Ming Luo et al., Isolation Enhancement of a Very Compact UWB-MIMO Slot Antenna With Two Defected Ground Structures, IEEE Antennas and Wireless Propagation Letters, vol. 14, 2015, pp. 1766-1769.
Ting-Sei Kang et al., Isolation Improvement of 2.4/5.2/5.8 GHz WLAN Internal Laptop Computer Antennas Using Dual-Band Strip Resonator as a Wavetrap, Microwave and Optical Technology Letters / vol. 52, No. 1, Jan. 2010, pp. 58-64.

(56) References Cited

OTHER PUBLICATIONS

Keith R. Carver, et al., Microstrip Antenna Technology, IEEE Transactions on Antennas and Propagation, vol. AP-29, No. Jan. 1, 1981, pp. 2-24.
David M. Pozar, Microstrip Antennas, Proceeding of the IEEE, vol. 80, No. 1, Jan. 1992, pp. 79-91.
Minseok Han et al., MIMO Antenna Using a Decoupling Network for 4G USB Dongle Application, Microwave and Optical Technology Letters / vol. 52, No. 11, Nov. 2010, pp. 2551-2554.
Jonathan Ethier, et al., MIMO Handheld Antenna Design Approach Using Characteristic Mode Concepts, Microwave and Optical Technology Letters / vol. 50, No. 7, Jul. 2008, pp. 1724-1727.
Reza Karimian, Novel F-Shaped Quad-Band Printed Slot Antenna for WLAN and WiMAX MIMO Systems, IEEE Antennas and Wireless Propagation Letters, vol. 12, 2013, pp. 405-408.
Jung-Hwan Choi et al., Performance Evaluation of 2×2 MIMO Handset Antenna Arrays for Mobile WiMAX Applications, Microwave and Optical Technology Letters / vol. 51, No. 6, Jun. 2009, pp. 1558-1561.
Saou-Wen Su, et al., Printed Coplanar Two-Antenna Element for 2.4/5 GHz WLAN Operation in a MIMO System, Microwave and Optical Technology Letters / vol. 50, No. 6, Jun. 2008, pp. 1635-1638.
Fan Yang, et al., Reflection Phase Characterizations of the EBG Ground Plane for Low Profile Wire Antenna Applications, IEEE Transactions on Antennas and Propagation, vol. 51, No. 10, Oct. 2003, pp. 2691-2702.
K. Payandehjoo et al., Suppression of Substrate Coupling Between Slot Antennas Using Electromagnetic Bandgap Structures, IEEE International Symposium on Antennas and Propagation, 2008.

* cited by examiner

INTEGRATED WIDEBAND ANTENNA

TECHNICAL FIELD

The technical field of the present disclosure is related to an integrated wideband antenna, especially to an integrated wideband antenna design structure for integration of multiple antennas.

BACKGROUND

The aim to improve wireless transmission quality and data transmission rate leads to the development needs of wideband antenna design. And the multi-input multiple-output (MIMO) multi-antenna structure and the application of beamforming multi-antenna array structure are popular. Antenna design with the advantages of wideband and multi-antenna array integration has become one of the popular research topics. However, how to successfully design a wideband antenna unit into a highly integrated multi-antenna array and achieve the advantages of good matching and good isolation at the same time is a technical challenge that is not easy to overcome.

A number of adjacent antennas with the same operating band may cause the problem of mutual coupling and interference and the problem of coupling and interference with nearby environment, thereby worsening the isolation between the multi-antennas, leading to the problem of attenuation in radiation characteristic of the antenna. Therefore, the data transmission rate is reduced, and the difficulty in the implementation of integrating multi-antennas increases.

Some prior art documentations have proposed a design method of designing periodic structures on the ground plane between multiple antennas as an energy isolator to improve the energy isolation between multiple antennas and the ability to resist interference from nearby environment. However, this kind of design method may cause instability factors during manufacturing process, which may increase the cost of mass production. Further, this design method may cause the excitation of additional coupling current, thereby increasing the correlation coefficients between multiple antennas. In addition, this design method may also increase the overall size of the multi-antenna array, for the array to be less likely implemented in various wireless devices or equipment.

Therefore, a design method to solve the above problems is needed, so as to meet the practical application requirements of future high data transmission rate communication devices or equipment.

SUMMARY

Accordingly, embodiments of this disclosure discloses an integrated wideband antenna. Some implementation examples according to the embodiments may solve the above-mentioned technical problems.

According to an exemplarily embodiment, the present disclosure provides an integrated wideband antenna. The integrated wideband antenna includes a first conductor layer, a first conductor patch, a second conductor patch, a feeding conductor structure and a signal source. The first conductor patch has a first coupling edge and a first connecting edge. The first connecting edge electrically connects with the first conductor layer through a first shorting structure, and the first conductor patch is spaced apart from the first conductor layer at a first interval. The second conductor patch has a second coupling edge and a second connecting edge. The second connecting edge electrically connects with the first conductor layer through a second shorting structure, and the second conductor patch is spaced apart from the first conductor layer at a second interval. The second coupling edge is spaced apart from the first coupling edge at a third interval to from a resonant open slot. The feeding conductor structure is located at the resonant open slot and has a first conductor line, a second conductor line and a third conductor line. The first conductor line is spaced apart from the first coupling edge at a first coupling interval. The second conductor line is spaced apart from the second coupling edge at a second coupling interval. The third conductor line electrically connects with the first conductor line and the second conductor line. The signal source is electrically coupled to the feeding conductor structure, and the signal source excites the integrated wideband antenna to generate a multi-resonance mode. The multi-resonance mode covers the at least one first communication band.

In order to have a better understanding of the above-mentioned and other contents of this disclosure, the following specific examples are given, and the accompanying drawings are described in detail as follows:

DETAILED DESCRIPTION

Figure 1A:
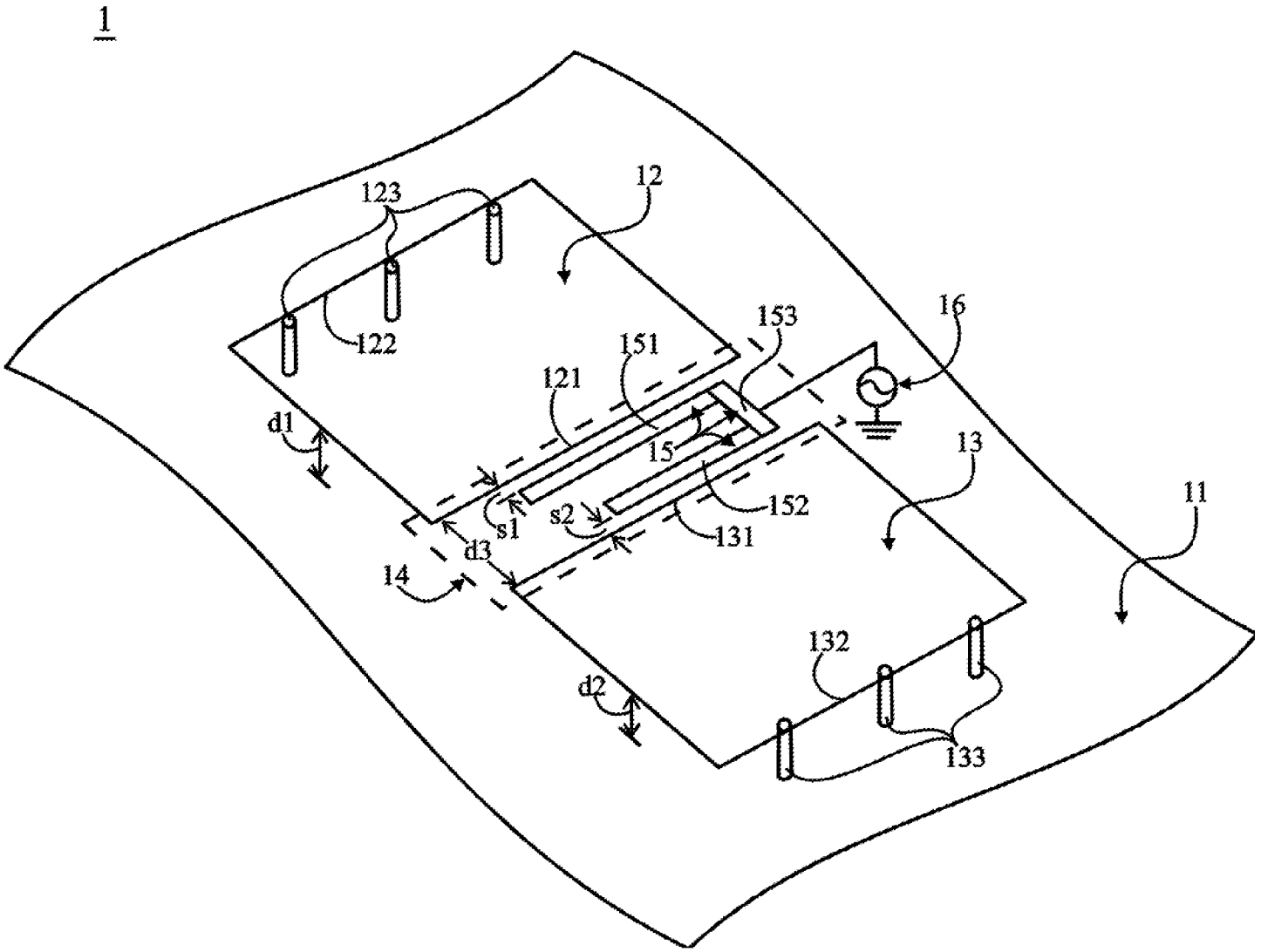
FIG. 1A is a structural diagram of the integrated wideband antenna 1 of an embodiment of the present disclosure.
Figure 1B:
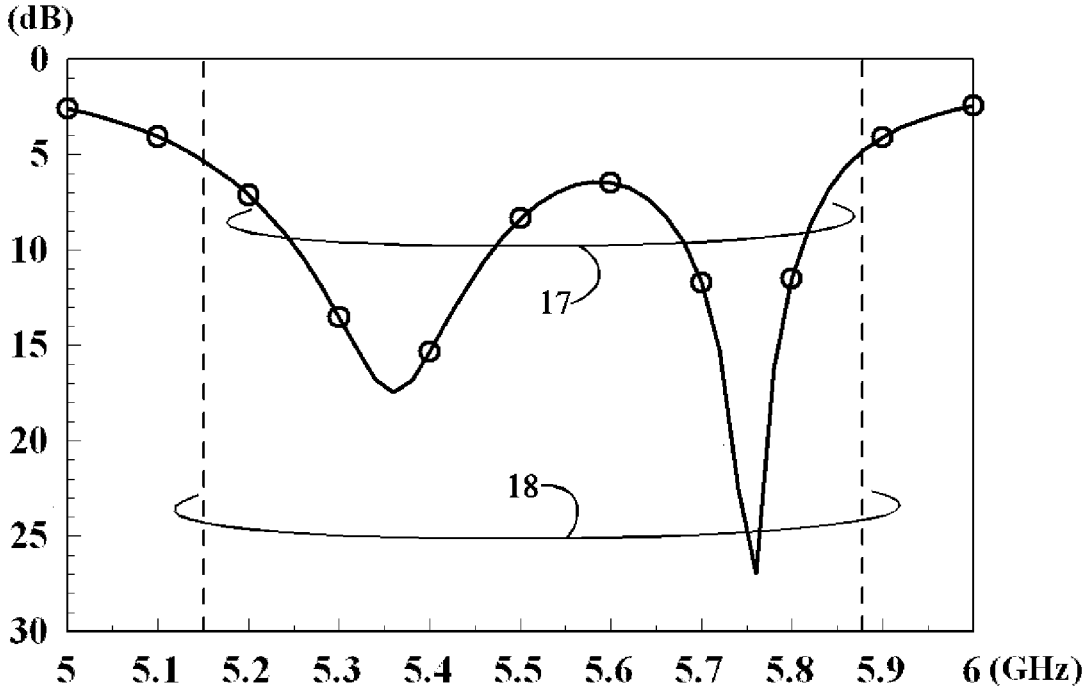
FIG. 1B is a return-loss diagram of the integrated wideband antenna 1 of an embodiment of the present disclosure.

FIG. 1A is a structural diagram of the integrated wideband antenna 1 of an embodiment of the present disclosure. As shown in FIG. 1A, the integrated wideband antenna 1 includes a first conductor layer 11, a first conductor patch 12, a second conductor patch 13, a feeding conductor structure 15 and a signal source 16. The first conductor patch 12 has a first coupling edge 121 and a first connecting edge 122. The first connecting edge 122 electrically connects with the first conductor layer 11 through a first shorting structure 123, and the first conductor patch 12 is spaced apart from the first conductor layer 11 at a first interval d1. The second conductor patch 13 has second coupling edge 131 and a second connecting edge 132. The second connecting edge 132 electrically connects with the first conductor layer 11 through a second shorting structure 133, and the second conductor patch 13 is spaced apart from the first conductor layer 11 at a second interval d2. The second coupling edge 131 is spaced apart from the first coupling edge 121 at a third interval d3 to form a resonant open slot 14. The first shorting structure 123 and the second shorting structure 133 are both formed by a number of conductor lines. The feeding conductor structure 15 is located at the resonant open slot 14 and has a first conductor line 151, a second conductor line 152 and a third conductor line 153. The first conductor line 151 is spaced apart from the first coupling edge 121 at a first coupling interval s1. The second conductor line 152 is spaced apart from the second coupling edge 131 at a second coupling interval s2. The third conductor line 153 electrically connects to the first conductor line 151 and the second conductor line 152. The signal source 16 is electrically coupled to the feeding conductor structure 15, and the signal source 16 excites the integrated wideband antenna 1 to generate a multi-resonance mode 17 (as shown in FIG. 1B). The multi-resonance mode 17 covers at least one first communication band 18 (as shown in FIG. 1B). The signal source 16 is a transmission line, an impedance matching circuit, an amplifier circuit, a feeding network, a switch circuit, a connector element, a filter circuit, an integrated circuit chip or a radio frequency front-end module. An area of the first conductor patch 12 and an area of the second conductor patch 13 are both between 0.1 wavelength square and 0.35 wavelength square of a lowest operating frequency of the first communication band 18. A distance of the first interval d1 and a distance of the second interval d2 are both between 0.005 wavelength and 0.18 wavelength of a lowest operating frequency of the first communication band 18. A length of the first conductor line 151 and a length of the second conductor line 152 are both between 0.03 wavelength and 0.38 wavelength of a lowest operating frequency of the first communication band 18. A distance of the first coupling interval s1 and a distance of the second coupling interval s2 are both between 0.001 wavelength and 0.05 wavelength of a lowest operating frequency of the first communication band 18. The second connecting edge 132 of the integrated wideband antenna 1 may electrically connect with the first connecting edge 122 of another set of the integrated wideband antenna 1, and is repeatedly connected to form an integrated wideband antenna array, and the integrated wideband antenna array may be applied to a multi-input multi-output antenna system or a beamforming antenna system.

In order to successfully achieve high integration and wideband effects, the integrated wideband antenna 1 of an embodiment of the present disclosure is first designed with the first conductor patch 12 and the second conductor patch 13 electrically connected with the first conductor layer 11, then is designed with forming a resonant open slot 14 between the second coupling edge 131 and the first coupling edge 121. Accordingly, an integrated antenna radiation structure of plate current and open slot magnetic current may be formed, effectively increasing the operation bandwidth of the multi-resonance mode 17. The integrated wideband antenna 1 is designed with the feeding conductor structure 15 having the first conductor line 151, the second conductor line 152 and the third conductor line 153. And the first conductor line 151 is designed to be spaced apart from the first coupling edge 121 at the first coupling interval s1, and the second conductor line 152 is designed to be spaced apart from the second coupling edge 131 at the second coupling interval s2, for the designed plate current and open slot magnetic current being able to coexist and excite well, and thus, the multi-resonance mode 17 may achieve good impedance matching. Further, the designed first shorting structure 123 and the second shorting structure 133 are capable of effectively suppressing leakage electric field energy of the first connecting edge 122 and the second connecting edge 132, to enhance the energy isolation of the adjacent integration of a number of sets of the integrated wideband antenna 1. Therefore, the second connecting edge 132 may electrically connect with the first connecting edge 122 of another set of the integrated wideband antenna 1, and is repeatedly connected to form an integrated wideband antenna array, and the integrated wideband antenna array may be applied to a multi-input multi-output antenna system or a beamforming antenna system. Therefore, the integrated wideband antenna 1 of an embodiment of the present disclosure may successfully achieve the technical effect of wideband and high integration.

Figure 1C:
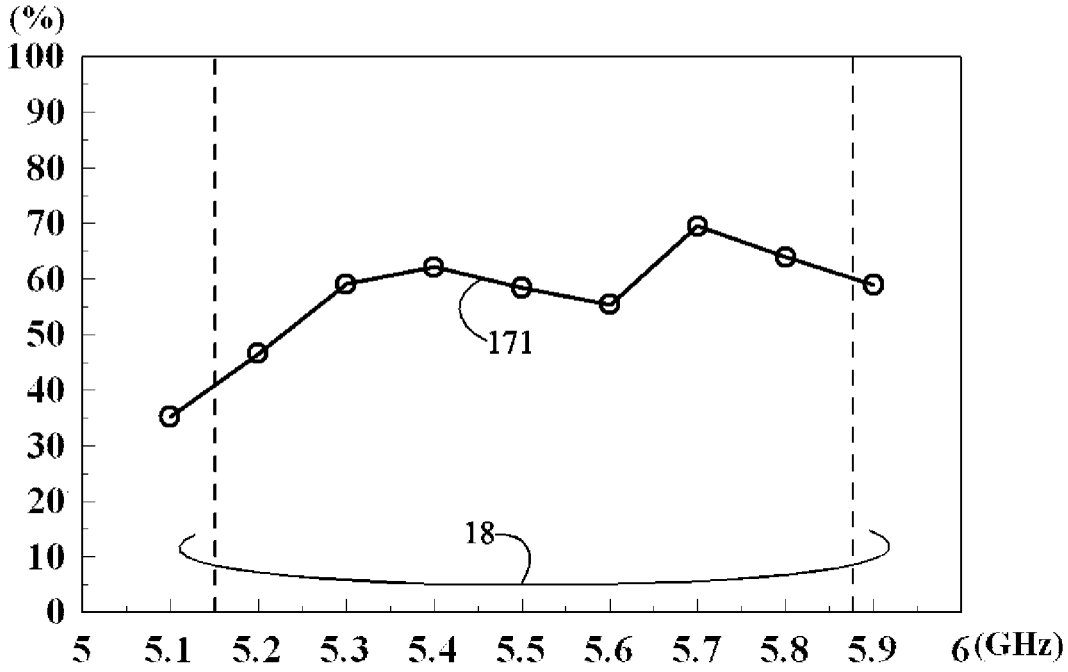
FIG. 1C is a radiation efficiency diagram of the integrated wideband antenna 1 of an embodiment of the present disclosure.

FIG. 1B is a return-loss diagram of the integrated wideband antenna 1 of an embodiment of the present disclosure, which selects the following sizes for experiments: the areas of the first conductor patch 12 and the second conductor patch 13 are both about 182 $mm^2$; the distances of the first interval d1 and the second interval d2 are both about 2 mm; the distance of the third interval d3 is about 3.5 mm; the length of the first conductor line 151 is about 9 mm; the length of the second conductor line 152 is about 5.3 mm; the distances of the first coupling interval s1 and the second coupling interval s2 are both about 0.2 mm. As shown in FIG. 1B, the signal source 16 excites the integrated wideband antenna 1 to generate a well-matched multi-resonance mode 17, and the multi-resonance mode 17 covers the at least one first communication band 18. In this embodiment, a range of a frequency band of the first communication band 18 is 5150 MHz-5875 MHz, a lowest operating frequency of the first communication band 18 is 5150 MHz. FIG. 1C is a radiation efficiency diagram of the integrated wideband antenna 1 of an embodiment of the present disclosure. As shown in FIG. 1C, the multi-resonance mode 17 generated by the signal source 16 exciting the integrated wideband antenna 1 has great radiation efficiency.

The covered communication bands and experiment data shown in FIG. 1B are only for experimentally proving the technical effects of the integrated wideband antenna 1 of an embodiment of the present disclosure in FIG. 1A, and are not used to limit the covered communication bands, application and specification of the integrated wideband antenna 1 of the present disclosure in practical application. The second connecting edge 132 of the integrated wideband antenna 1 of the present disclosure may electrically connect with the first connecting edge 122 of another set of the integrated wideband antenna 1, and is repeatedly connected to form an integrated wideband antenna array, and the integrated wideband antenna array may be applied to a multi-input multi-output antenna system or a beamforming antenna system.

Figure 2A:
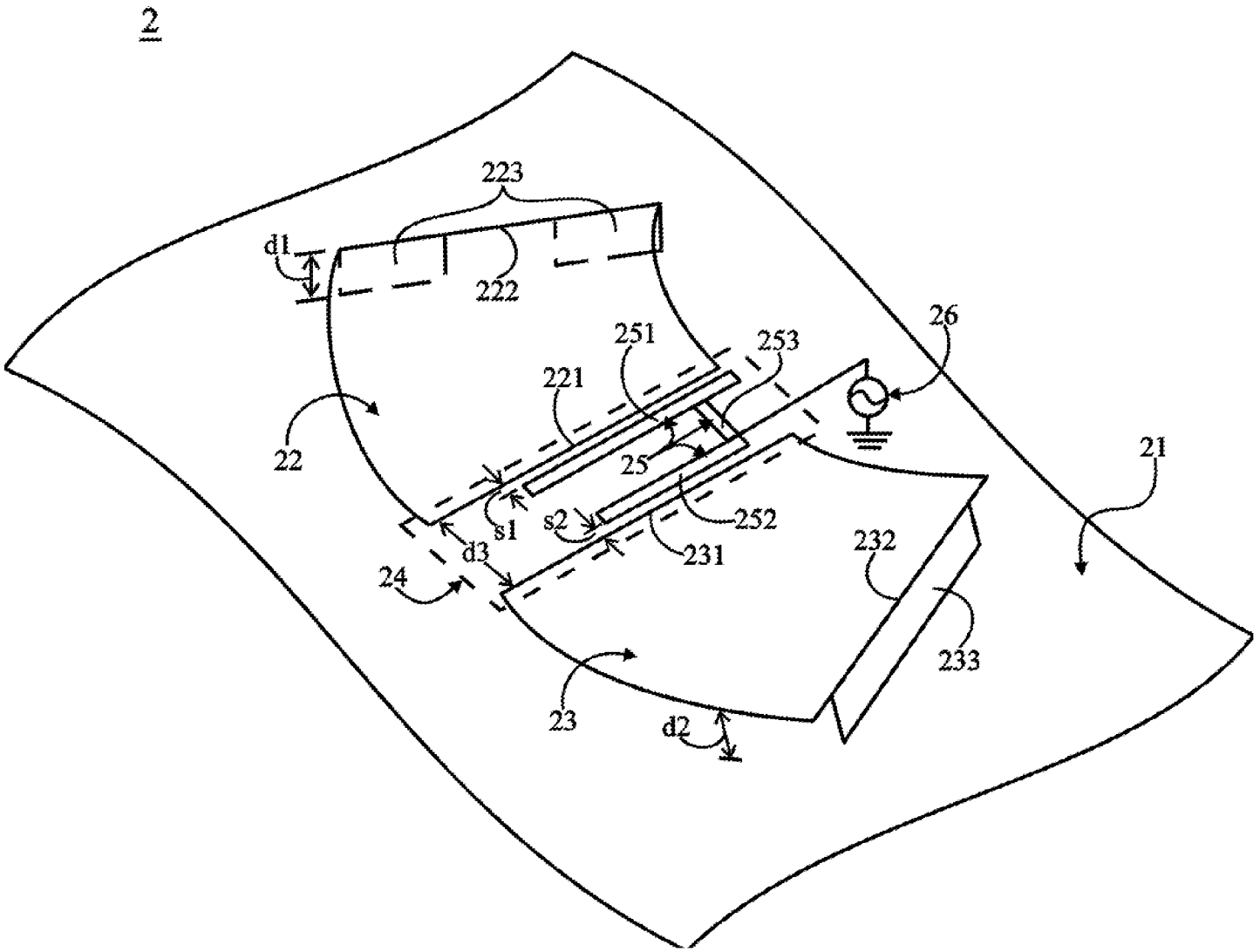
FIG. 2A is a structural diagram of the integrated wideband antenna 2 of an embodiment of the present disclosure.
Figure 2B:
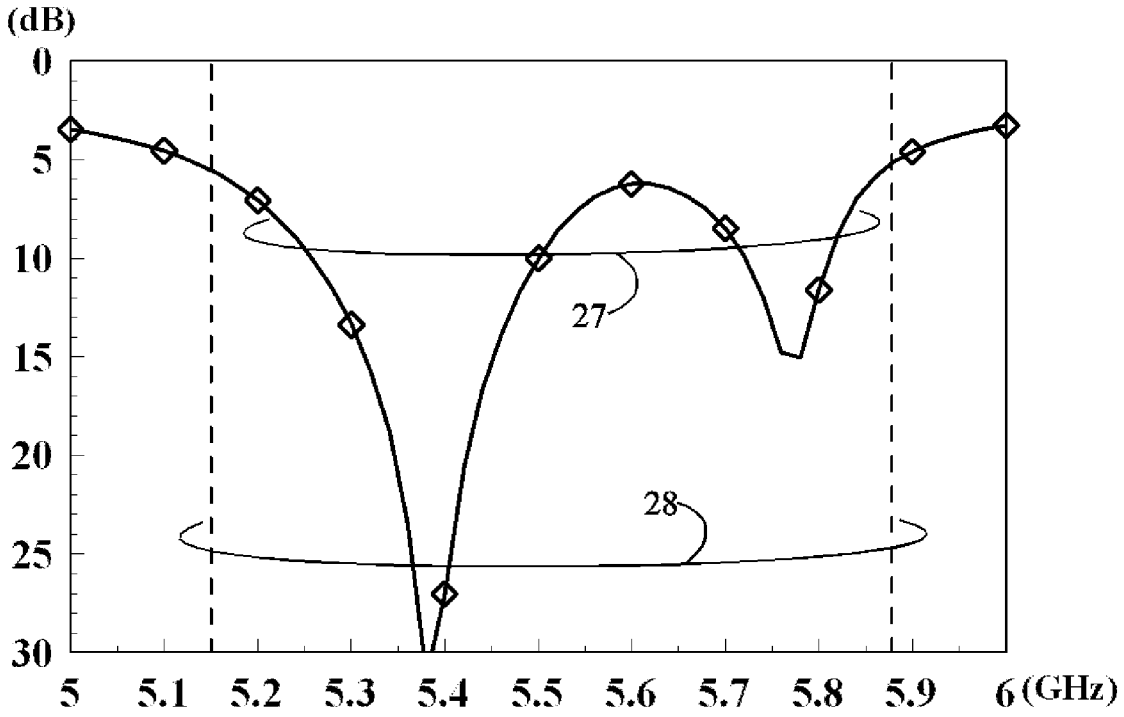
FIG. 2B is a return-loss diagram of the integrated wideband antenna 2 of an embodiment of the present disclosure.

FIG. 2A is a structural diagram of the integrated wideband antenna 2 of an embodiment of the present disclosure. As shown in FIG. 2A, the integrated wideband antenna 2 includes a first conductor layer 21, a first conductor patch 22, a second conductor patch 23, a feeding conductor structure 25 and a signal source 26. The first conductor patch 22 has first coupling edge 221 and a first connecting edge 222. The first connecting edge 222 electrically connects with the first conductor layer 21 through a first shorting structure 223, and the first conductor patch 22 is spaced apart from the first conductor layer 21 at a first interval d1. The second conductor patch 23 has a second coupling edge 231 and a second connecting edge 232. The second connecting edge 232 electrically connects with the first conductor layer 21 through a second shorting structure 233, and the second conductor patch 23 is spaced apart from the first conductor layer 21 at a second interval d2. The second coupling edge 231 is spaced apart from the first coupling edge 221 at a third interval d3 to form a resonant open slot 24. The first shorting structure 223 is composed of two conductor sheets. The second shorting structure 233 is composed of a single conductor sheet. The feeding conductor structure 25 is located at the resonant open slot 24 and has a first conductor line 251, a second conductor line 252 and a third conductor line 253. The first conductor line 251 is spaced apart from the first coupling edge 221 at a first coupling interval s1. The second conductor line 252 is spaced apart from the second coupling edge 231 at a second coupling interval s2. The third conductor line 253 electrically connects with the first conductor line 251 and the second conductor line 252. The signal source 26 is electrically coupled to the feeding conductor structure 25, and the signal source 26 excites the integrated wideband antenna 2 to generate a multi-resonance mode 27 (as shown in FIG. 2B). The multi-resonance mode 27 covers the at least one first communication band 28 (as shown in FIG. 2B). The signal source 26 is a transmission line, an impedance matching circuit, an amplifier circuit, a feeding network, a switch circuit, a connector element, a filter circuit, an integrated circuit chip or a radio frequency front-end module. An area of the first conductor patch 22 and an area of the second conductor patch 23 are both between 0.1 wavelength square and 0.35 wavelength square of a lowest operating frequency of the first communication band 28. A distance of the first interval d1 and a distance of the second interval d2 are both between 0.005 wavelength and 0.18 wavelength of a lowest operating frequency of the first communication band 28. A length of the first conductor line 251 and a length of the second conductor line 252 are both between 0.03 wavelength and 0.38 wavelength of a lowest operating frequency of the first communication band 28. A distance of the first coupling interval s1 and a distance of the second coupling interval s2 are both between 0.001 wavelength and 0.05 wavelength of a lowest operating frequency of the first communication band 28. The second connecting edge 232 of the integrated wideband antenna 2 may electrically connect with the first connecting edge 222 of another set of the integrated wideband antenna 2, and is repeatedly connected to form an integrated wideband antenna array, and the integrated wideband antenna array may be applied to a multi-input multi-output antenna system or a beamforming antenna system.

Even though in the integrated wideband antenna 2 of an embodiment of the present disclosure shown in FIG. 2A, the shapes of the first conductor patch 22, the second conductor patch 23 and the feeding conductor structure 25 are not entirely the same as the integrated wideband antenna 1, the first shorting structure 223 and the second shorting structure 233 are composed of conductor sheets, but the integrated wideband antenna 2 is also designed with the first conductor patch 22 and the second conductor patch 23 electrically connected with the first conductor layer 21, and is then designed with forming a resonant open slot 24 between the second coupling edge 231 and the first coupling edge 221. Accordingly, an integrated antenna radiation structure of plate current and open slot magnetic current may be formed, effectively increasing the operation bandwidth of the multi-resonance mode 27. The integrated wideband antenna 2 is also designed with the feeding conductor structure 25 having the first conductor line 251, the second conductor line 252 and the third conductor line 253, and the first conductor line 251 is designed to be spaced apart from the first coupling edge 221 at the first coupling interval s1 and the second conductor line 252 is designed to be spaced apart from the second coupling edge 231 at the second coupling interval s2, for the designed plate current and open slot magnetic current being able to coexist and excite well. Therefore, the multi-resonance mode 27 may achieve good impedance matching. Further, the designed first shorting structure 223 and the second shorting structure 233 are capable of effectively suppressing leakage electric field energy of the first connecting edge 222 and the second connecting edge 232, to enhance the energy isolation of the adjacent integration of a number of sets of the integrated wideband antenna 2. Therefore, the second connecting edge 232 may electrically connect with the first connecting edge 222 of another set of the integrated wideband antenna 2, and is repeatedly connected to form an integrated wideband antenna array, and the integrated wideband antenna array may be applied to a multi-input multi-output antenna system or a beamforming antenna system. Therefore, the integrated wideband antenna 2 of an embodiment of the present disclosure may also successfully achieve the technical effect of wideband and high integration.

FIG. 2B is a return-loss diagram of the integrated wideband antenna 2 of an embodiment of the present disclosure, which selects the following sizes for experiments: the areas of the first conductor patch 22 and the second conductor patch 23 are both about 145 $mm^2$; the distances of the first interval d1 and the second interval d2 are both about 1.5 mm; the distance of the third interval d3 is about 3.5 mm; the length of the first conductor line 251 is about 11.5 mm; the length of the second conductor line 252 is about 4.1 mm; the distances of the first coupling interval s1 and the second coupling interval s2 are both about 0.18 mm. As shown in FIG. 2B, the signal source 26 excites the integrated wideband antenna 2 to generate a well-matched multi-resonance mode 27, and the multi-resonance mode 27 covers the at least one first communication band 28. In this embodiment, a range of a frequency band of the first communication band 28 is 5150 MHz-5875 MHz, a lowest operating frequency of the first communication band 28 is 5150 MHz.

The covered communication bands and experiment data shown in FIG. 2B are only for experimentally proving the technical effects of the integrated wideband antenna 2 of an embodiment of the present disclosure in FIG. 2A, and are not used to limit the covered communication bands, application and specification of the integrated wideband antenna 2 of the present disclosure in practical application. The second connecting edge 232 of the integrated wideband antenna 2 may electrically connect with the first connecting edge 222 of another set of the integrated wideband antenna 2, and is repeatedly connected to form an integrated wideband antenna array, and the integrated wideband antenna array may be applied to a multi-input multi-output antenna system or a beamforming antenna system.

Figure 3A:
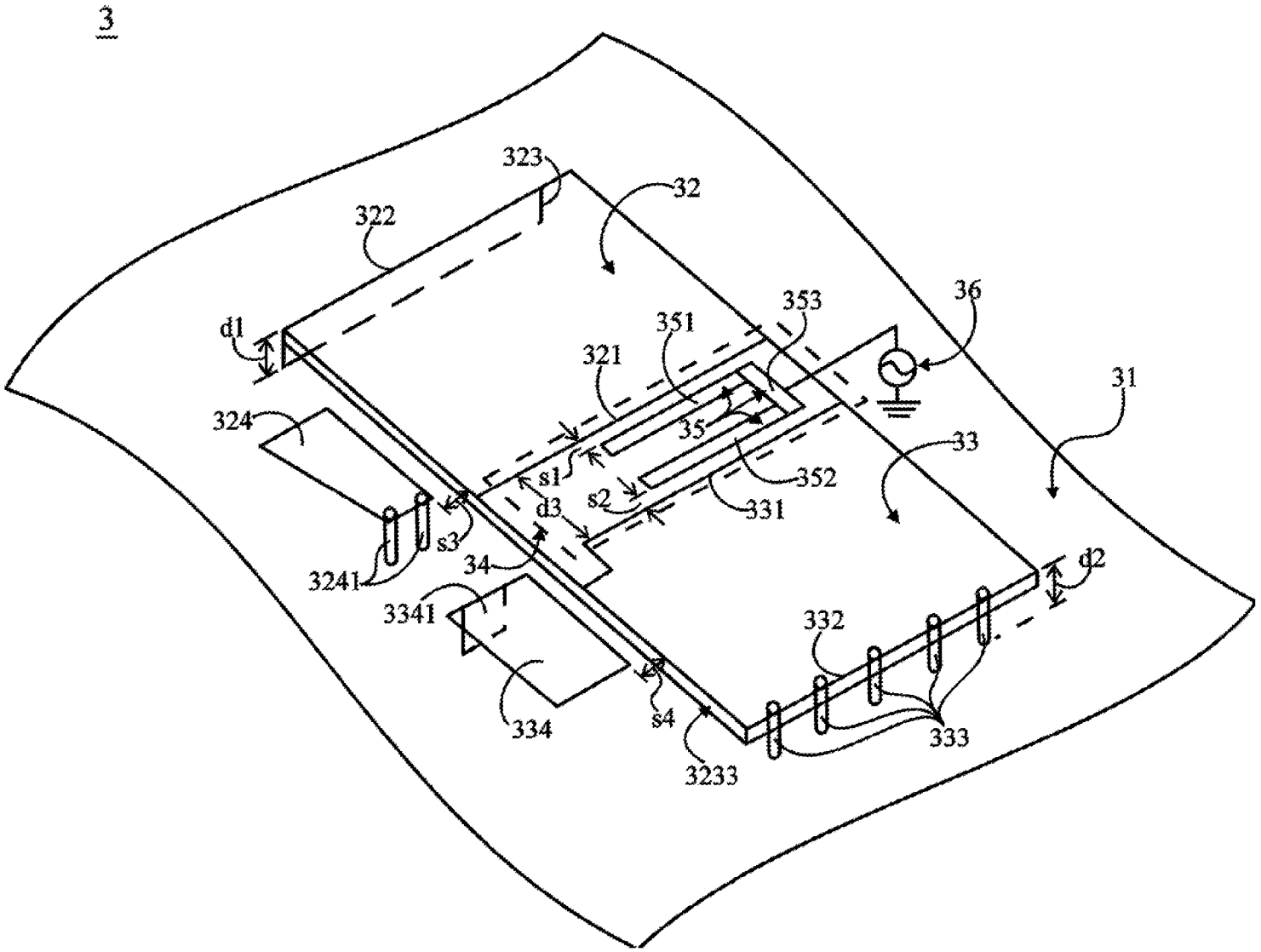
FIG. 3A is a structural diagram of the integrated wideband antenna 3 of an embodiment of the present disclosure.
Figure 3B:
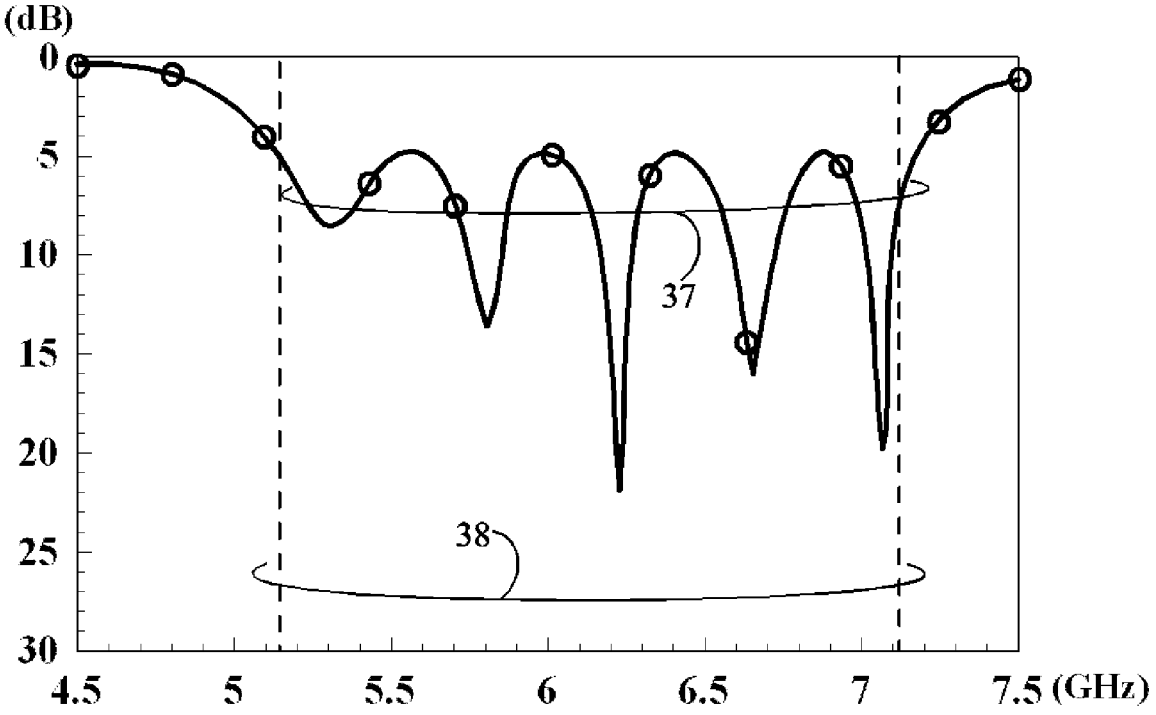
FIG. 3B is a return-loss diagram of the integrated wideband antenna 3 of an embodiment of the present disclosure.

FIG. 3A is a structural diagram of the integrated wideband antenna 3 of an embodiment of the present disclosure. As shown in FIG. 3A, the integrated wideband antenna 3 includes a first conductor layer 31, a first conductor patch 32, a second conductor patch 33, a feeding conductor structure 35 and a signal source 36. The first conductor patch 32 has a first coupling edge 321 and a first connecting edge 322. The first connecting edge 322 electrically connects with the first conductor layer 31 through a first shorting structure 323, and the first conductor patch 32 is spaced apart from the first conductor layer 31 at a first interval d1. The second conductor patch 33 has a second coupling edge 331 and a second connecting edge 332. The second connecting edge 332 electrically connects with the first conductor layer 31 through a second shorting structure 333, and the second conductor patch 33 is spaced apart from the first conductor layer 31 at a second interval d2. The second coupling edge 331 is spaced apart from the first coupling edge 321 at a third interval d3 to form a resonant open slot 34. The first shorting structure 323 is composed of a single conductor sheet. The second shorting structure 333 is composed of a number of conductor lines. The feeding conductor structure 35 is located at the resonant open slot 34, and has a first conductor line 351, a second conductor line 352 and a third conductor line 353. The first conductor line 351 is spaced apart from the first coupling edge 321 at a first coupling interval s1. The second conductor line 352 is spaced apart from the second coupling edge 331 at a second coupling interval s2. The third conductor line 353 electrically connects with the first conductor line 351 and the second conductor line 352. The first conductor patch 32, the second conductor patch 33 and the feeding conductor structure 35 may be formed on single-layer or multi-layer substrate. The signal source 36 is electrically coupled to the feeding conductor structure 35, and the signal source 36 excites the integrated wideband antenna 3 to generate a multi-resonance mode 37 (as shown in FIG. 3B). The multi-resonance mode 37 covers the at least one first communication band 38 (as shown in FIG. 3B). The signal source 36 is a transmission line, an impedance matching circuit, an amplifier circuit, a feeding network, a switch circuit, a connector element, a filter circuit, an integrated circuit chip or a radio frequency front-end module. The first conductor patch 32, the second conductor patch 33 and the feeding conductor structure 35 are formed on a single-layer substrate 3233. The integrated wideband antenna 3 has a third conductor patch 324 electrically connected with the first conductor layer 31 through a third shorting structure 3241, and the third conductor patch 324 is spaced apart from the first conductor patch 31 at a third coupling interval s3. The third shorting structure 3241 is composed of two conductor lines, a distance of the third coupling interval s3 is between 0.001 wavelength and 0.05 wavelength of a lowest operating frequency of the first communication band 38. The integrated wideband antenna 3 has a fourth conductor patch 334 electrically connected with the first conductor layer 31 through a fourth shorting structure 3341, and the fourth conductor patch 334 is spaced apart from the first conductor patch 31 at a fourth coupling interval s4. The fourth shorting structure 3341 is composed of a single conductor sheet, and a distance of the fourth coupling interval s4 is between 0.001 wavelength and 0.05 wavelength of a lowest operating frequency of the first communication band 38. An area of the first conductor patch 32 and an area of the second conductor patch 33 are both between 0.1 wavelength square and 0.35 wavelength square of a lowest operating frequency of the first communication band 38. A distance of the first interval d1 and a distance of the second interval d2 are both between 0.005 wavelength and 0.18 wavelength of a lowest operating frequency of the first communication band 38. A length of the first conductor line 351 and a length of the second conductor line 352 are both between 0.03 wavelength and 0.38 wavelength of a lowest operating frequency of the first communication band 38. A distance of the first coupling interval s1 and a distance of the second coupling interval s2 are both between 0.001 wavelength and 0.05 wavelength of a lowest operating frequency of the first communication band 38. The second connecting edge 332 of the integrated wideband antenna 3 may electrically connect with the first connecting edge 322 of another set of the integrated wideband antenna 3, and is repeatedly connected to form an integrated wideband antenna array, and the integrated wideband antenna array may be applied to a multi-input multi-output antenna system or a beamforming antenna system.

Even though in the integrated wideband antenna 3 of an embodiment of the present disclosure shown in FIG. 3A, the shapes of the second conductor patch 33 and the feeding conductor structure 35 are not entirely the same as the integrated wideband antenna 1, the first shorting structure 323 is composed of a single conductor sheet, and the integrated wideband antenna 3 has a third conductor patch 324 and a fourth conductor patch 334, but the integrated wideband antenna 3 is also designed with the first conductor patch 32 and the second conductor patch 33 electrically connected with the first conductor layer 31, and is then designed with forming a resonant open slot 34 between the second coupling edge 331 and the first coupling edge 321. Accordingly, an integrated antenna radiation structure of plate current and open slot magnetic current may be formed, effectively increasing the operation bandwidth of the multi-resonance mode 37. The integrated wideband antenna 3 is also designed with the feeding conductor structure 35 having the first conductor line 351, the second conductor line 352 and the third conductor line 353, and the first conductor line 351 is designed to be spaced apart from the first coupling edge 321 at the first coupling interval s1 and the second conductor line 352 is designed to be spaced apart from the second coupling edge 331 at the second coupling interval s2, for the designed plate current and open slot magnetic current being able to coexist and excite well. Therefore, the multi-resonance mode 37 may achieve good impedance matching. Further, the designed first shorting structure 323 and the second shorting structure 333 are capable of effectively suppressing leakage electric field energy of the first connecting edge 322 and the second connecting edge 332, to enhance the energy isolation of the adjacent integration of a number of sets of the integrated wideband antenna 3. Therefore, the second connecting edge 332 may electrically connect with the first connecting edge 322 of another set of the integrated wideband antenna 3, and is repeatedly connected to form an integrated wideband antenna array, and the integrated wideband antenna array may be applied to a multi-input multi-output antenna system or a beamforming antenna system. Therefore, the integrated wideband antenna 3 of an embodiment of the present disclosure may also successfully achieve the technical effect of wideband and high integration.

FIG. 3B is a return-loss diagram of the integrated wideband antenna 3 of an embodiment of the present disclosure, which selects the following sizes for experiments: the area of the first conductor patch 32 is about 159 $mm^2$; the area of the second conductor patch 33 is about 132 $mm^2$; the distances of the first interval d1 and the second interval d2 are both about 0.5 mm; the distance of the third interval d3 is about 3.6 mm; the length of the first conductor line 351 is about 16.5 mm; the length of the second conductor line 352 is about 6.6 mm; the distances of the first coupling interval s1 and the second coupling interval s2 are both about 0.2 mm; the distances of the third coupling interval s3 and the fourth coupling interval s4 are both about 1.1 mm. As shown in FIG. 3B, the signal source 36 excites the integrated wideband antenna 3 to generate a well-matched multi-resonance mode 37, and the multi-resonance mode 37 covers the at least one first communication band 38. In this embodiment, a range of a frequency band of the first communication band 38 is 5150 MHz-7125 MHz, a lowest operating frequency of the first communication band 38 is 5150 MHz.

The covered communication bands and experiment data shown in FIG. 3B are only for experimentally proving the technical effects of the integrated wideband antenna 3 of an embodiment of the present disclosure in FIG. 3A, and are not used to limit the covered communication bands, application and specification of the integrated wideband antenna 3 of the present disclosure in practical application. The second connecting edge 332 of the integrated wideband antenna 3 of the present disclosure may electrically connect with the first connecting edge 322 of another set of the integrated wideband antenna 3, and is repeatedly connected to form an integrated wideband antenna array, and the integrated wideband antenna array may be applied to a multi-input multi-output antenna system or a beamforming antenna system.

Figure 4A:
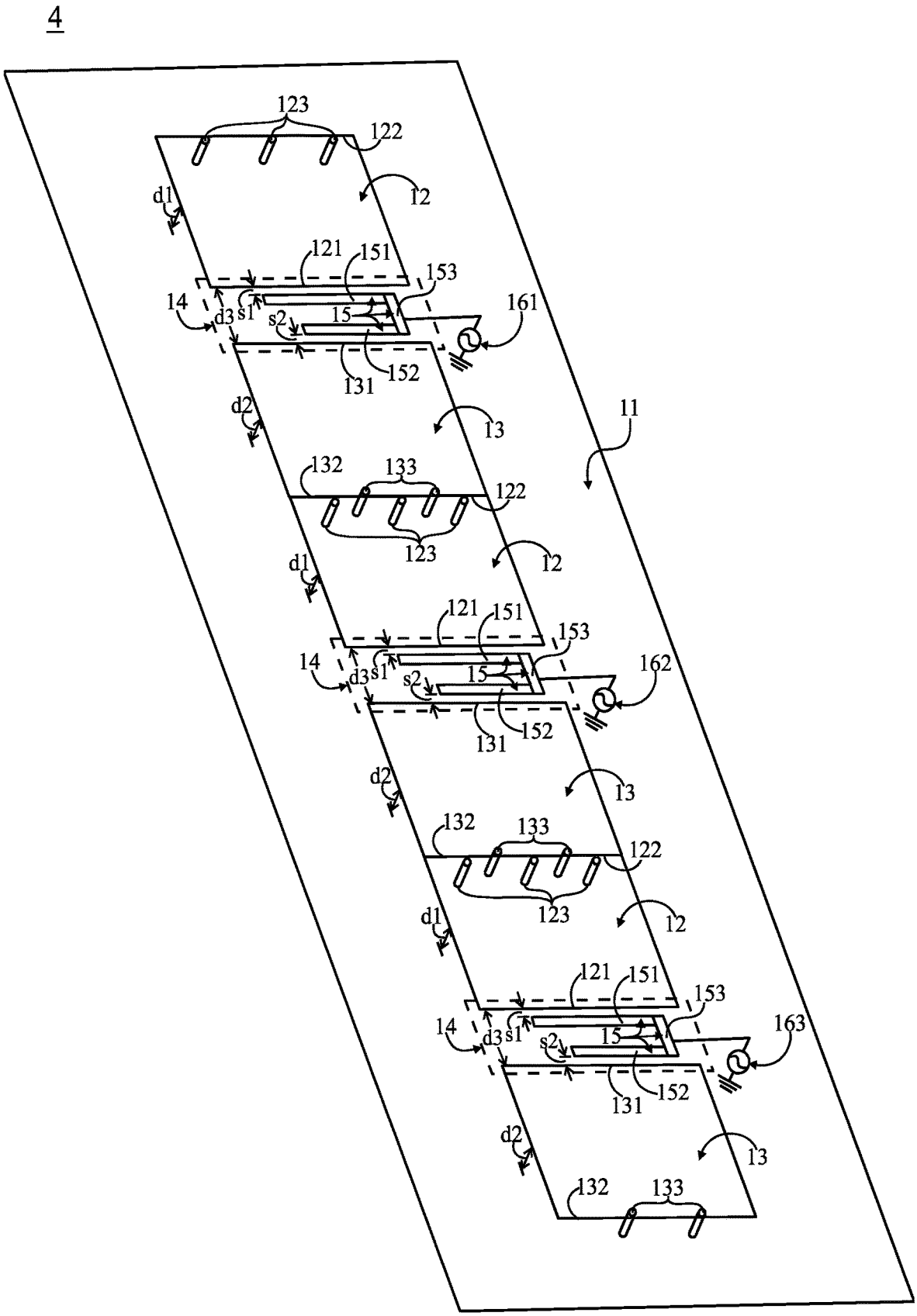
FIG. 4A is a structural diagram of three sets of integrated wideband antennas 1 connected to form the integrated wideband antenna array 4 of an embodiment of the present disclosure.

FIG. 4A is a structural diagram of three sets of integrated wideband antennas 1 (as shown in FIG. 1A) connected to form an integrated wideband antenna array 4 of an embodiment of the present disclosure. The second connecting edge 132 of the integrated wideband antenna electrically connects with the first connecting edge 122 of another set of the integrated wideband antenna 1, and is repeatedly connected with three sets of integrated wideband antennas 1 to form an integrated wideband antenna array 4, and the integrated wideband antenna array 4 may be applied to a multi-input multi-output antenna system or a beamforming antenna system. In the exemplarily embodiment of FIG. 4A, the three sets of the integrated wideband antennas have a signal source 161, a signal source 162 and a signal source 163 respectively. The signal source 161 performs excitation to generate a multi-resonance mode 471, the signal source 162 performs excitation to generate a multi-resonance mode 472, and the signal source 163 performs excitation to generate a multi-resonance mode 473 (as in shown FIG. 4B).

Figure 4B:
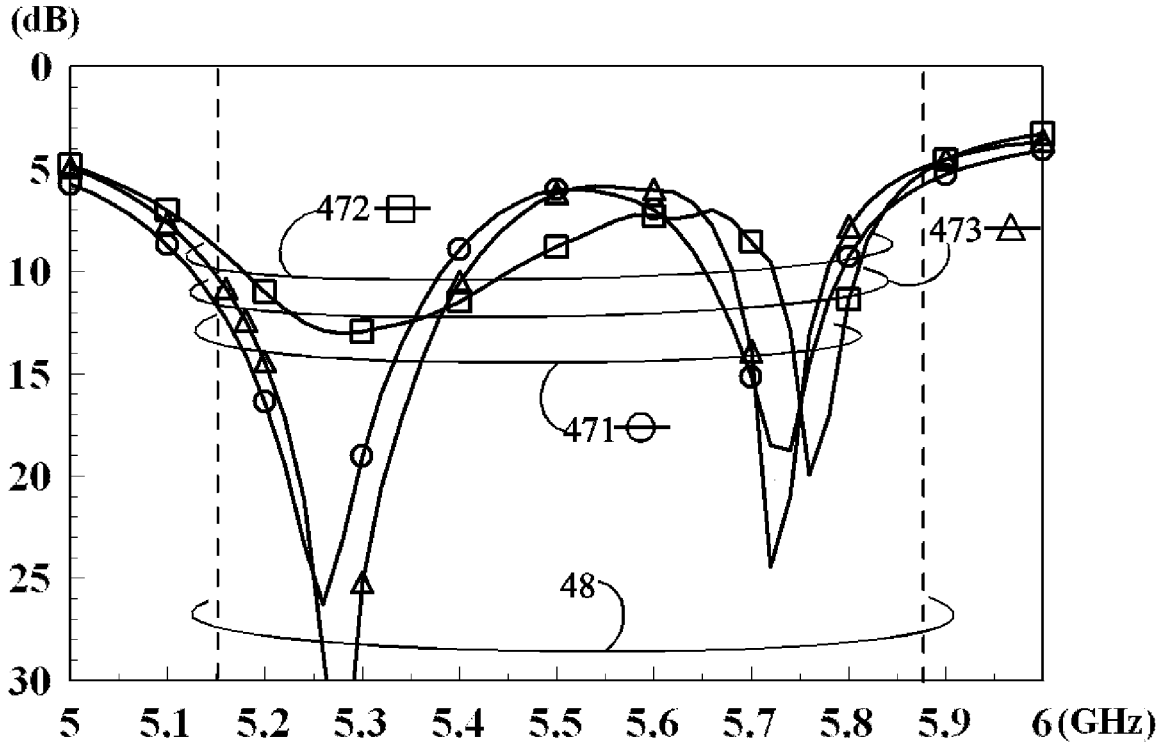
FIG. 4B is a structural diagram of three sets of integrated wideband antennas 1 connected to form the integrated wideband antenna array 4 of an embodiment of the present disclosure.

In the exemplarily embodiment of FIG. 4A, even though three sets of the integrated wideband antennas 1 are connected (as shown in FIG. 1A), but the integrated wideband antenna of each set is designed with the first conductor patch 12 and the second conductor patch 13 electrically connected with the first conductor layer 11, and is then designed with forming a resonant open slot 14 between the second coupling edge 131 and the first coupling edge 121. Accordingly, an integrated antenna radiation structure of plate current and open slot magnetic current may be formed, effectively increasing the operation bandwidths of the multi-resonance modes 471, 472, 473 (as shown in FIG. 4B). Each set of the integrated wideband antenna is also designed with the feeding conductor structure 15 having the first conductor line 151, the second conductor line 152 and the third conductor line 153, and designed with the first conductor line 151 spaced apart from the first coupling edge 121 at the first coupling interval s1 and designed with the second conductor line 152 spaced apart from the second coupling edge 131 at the second coupling interval s2, for the designed plate current and open slot magnetic current being able to coexist and excite well. Therefore, the multi-resonance modes 471, 472, 473 may all achieve good impedance matching (as shown in FIG. 4B). Each set designed with the first shorting structure 123 and the second shorting structure 133 are also capable of effectively suppressing the leakage electric field energy of the first connecting edge 122 and the second connecting edge 132, to enhance the energy isolation of the adjacent integration of a number of sets of the integrated wideband antenna 3. Therefore, each set of the integrated wideband antenna in FIG. 4A may also successfully achieve the technical effect of wideband and high integration.

Figure 4C:
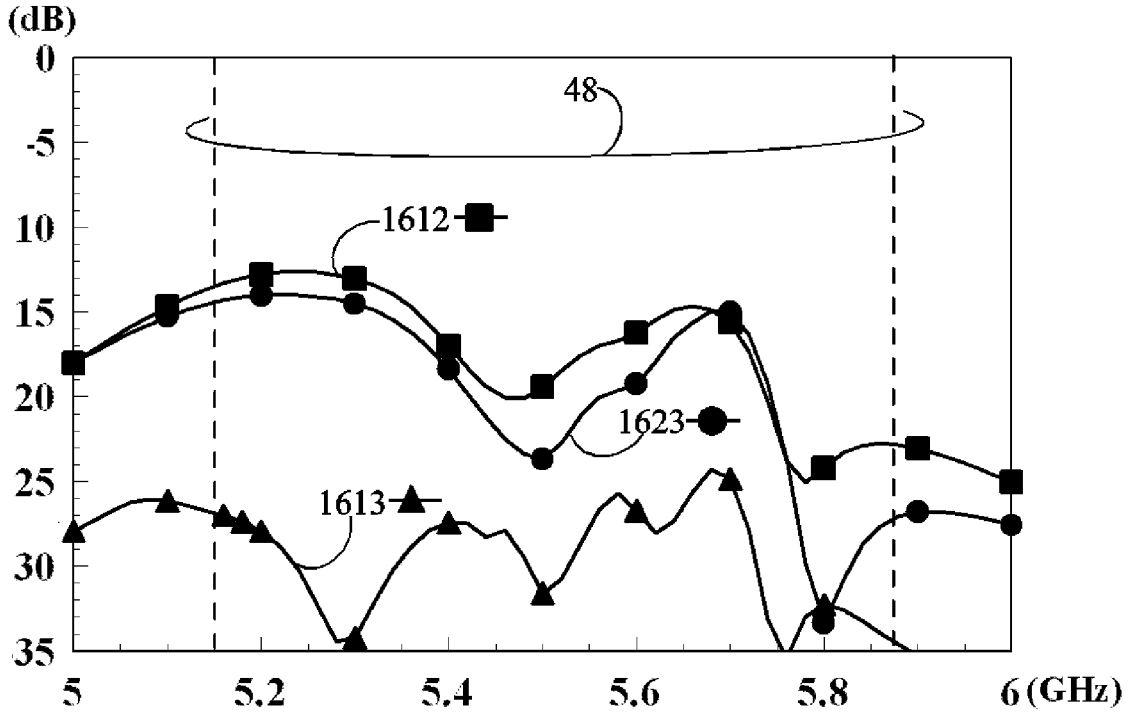
FIG. 4C is a curve diagram showing degree of isolation of three sets of integrated wideband antennas 1 connected to form the integrated wideband antenna array 4 of an embodiment of the present disclosure.

FIG. 4B and FIG. 4C are return-loss diagram and curve diagram showing degree of isolation of the connected three sets of the integrated wideband antenna arrays. As shown in FIG. 4A and FIG. 4B, the signal source 161 performs excitation to generate a multi-resonance mode 471, the signal source 162 performs excitation to generate a multi-resonance mode 472, and the signal source 163 performs excitation to generate a multi-resonance mode 473. As shown in FIG. 4B, the three sets of the integrated wideband antenna arrays may all generate well-matched multi-resonance modes 471, 472, 473 respectively, and the three sets of the multi-resonance modes 471, 472, 473 all cover the at least one first communication band 48. In this embodiment, a range of a frequency band of the first communication band 48 is 5150 MHz-5875 MHz, and a lowest operating frequency of the first communication band 48 is 5150 MHz. As shown in FIG. 4A and FIG. 4C, the isolation curve between the signal source 161 and the signal source 162 is 1612, the isolation curve between the signal source 162 and the signal source 163 is 1623, and the isolation curve between the signal source 161 and the signal source 163 is 1613. As shown in FIG. 4C, good isolation may be achieved between the three sets of the integrated wideband antenna arrays.

The covered communication bands and experiment data shown in FIG. 4B and FIG. 4C are only for experimentally proving the technical effects of three sets of integrated wideband antennas connected to form an integrated wideband antenna array 4 in FIG. 4A, and are not used to limit the covered communication bands, application and specification of the integrated wideband antenna array 4 of the present disclosure in practical application.

Although the aforementioned embodiments of this invention have been described above, this invention is not limited thereto. The amendment and the retouch, which do not depart from the spirit and scope of this invention, should fall within the scope of protection of this invention. For the scope of protection defined by this invention, please refer to the attached claims.

SYMBOLIC EXPLANATION

1, 2, 3: integrated wideband antenna
4: integrated wideband antenna array
11, 21, 31: first conductor layer
12, 22, 32: first conductor patch
121, 221, 321: first coupling edge
122, 222, 322: first connecting edge
123, 223, 323: first shorting structure
324: third conductor patch
3241: third shorting structure
13, 23, 33: second conductor patch
131, 231, 331: second coupling edge
132, 232, 332: second connecting edge
133, 233, 333: second shorting structure
334: fourth conductor patch
3341: fourth shorting structure
3233: substrate
14, 24, 34: resonant open slot
15, 25, 35: feeding conductor structure
151, 251, 351: first conductor line
152, 252, 352: second conductor line

153, 253, 353: third conductor line
16, 26, 36, 461, 462, 463: signal source
17, 27, 37, 471, 472, 473: multi-resonance mode
171: radiation efficiency curve
18, 28, 38, 48: first communication band
1612, 1613, 1623: isolation curve
d1: first interval
d2: second interval
d3: third interval
s1: first coupling interval
s2: second coupling interval
s3: third coupling interval
s4: fourth coupling interval

What is claimed is:

1. An integrated wideband antenna, comprising:

a first conductor layer;

a first conductor patch, having a first coupling edge and a first connecting edge, wherein the first connecting edge electrically connects with the first conductor layer through a first shorting structure, and the first conductor patch is spaced apart from the first conductor layer at a first interval;

a second conductor patch, having a second coupling edge and a second connecting edge, wherein the second connecting edge electrically connects with the first conductor layer through a second shorting structure, the second conductor patch is spaced apart from the first conductor layer at a second interval, and the second coupling edge is spaced apart from the first coupling edge at a third interval to form a resonant open slot;

a feeding conductor structure, located at the resonant open slot and having a first conductor line, a second conductor line and a third conductor line, wherein the first conductor line is spaced apart from the first coupling edge at a first coupling interval, the second conductor line is spaced apart from the second coupling edge at a second coupling interval, and the third conductor line electrically connects to the first conductor line and the second conductor line; and a signal source, electrically coupled to the feeding conductor structure, wherein the signal source excites the integrated wideband antenna to generate a multi-resonance mode covering at least one first communication band.

2. The integrated wideband antenna according to claim 1, wherein the first shorting structure and the second shorting structure are composed of single or multiple conductor sheets or conductor lines.

3. The integrated wideband antenna according to claim 1, wherein an area of the first conductor patch is between 0.1 wavelength square and 0.35 wavelength square of a lowest operating frequency of the first communication band.

4. The integrated wideband antenna according to claim 1, wherein an area of the second conductor patch is between 0.1 wavelength square and 0.35 wavelength square of a lowest operating frequency of the first communication band.

5. The integrated wideband antenna according to claim 1, wherein a distance of the first interval is between 0.005 wavelength and 0.18 wavelength of a lowest operating frequency of the first communication band.

6. The integrated wideband antenna according to claim 1, wherein a distance of the second interval is between 0.005 wavelength and 0.18 wavelength of a lowest operating frequency of the first communication band.

7. The integrated wideband antenna according to claim 1, wherein a distance of the third interval is between 0.001 wavelength and 0.15 wavelength of a lowest operating frequency of the first communication band.

8. The integrated wideband antenna according to claim 1, wherein a length of the first conductor line is between 0.03 wavelength and 0.38 wavelength of a lowest operating frequency of the first communication band.

9. The integrated wideband antenna according to claim 1, wherein a length of the second conductor line is between 0.03 wavelength and 0.38 wavelength of a lowest operating frequency of the first communication band.

10. The integrated wideband antenna according to claim 1, wherein a distance of the first coupling interval is between 0.001 wavelength and 0.05 wavelength of a lowest operating frequency of the first communication band.

11. The integrated wideband antenna according to claim 1, wherein a distance of the second coupling interval is between 0.001 wavelength and 0.05 wavelength of a lowest operating frequency of the first communication band.

12. The integrated wideband antenna according to claim 1, wherein the signal source is a transmission line, an impedance matching circuit, an amplifier circuit, a feeding network, a switch circuit, a connector element, a filter circuit, an integrated circuit chip or a radio frequency front-end module.

13. The integrated wideband antenna according to claim 1, further comprising a third conductor patch electrically connected with the first conductor patch through a third shorting structure, wherein the third conductor patch is spaced apart from the first conductor patch at a third coupling interval.

14. The integrated wideband antenna according to claim 13, wherein the third shorting structure is composed of single or multiple conductor sheets or conductor lines, and a distance of the third coupling interval is between 0.001 wavelength and 0.05 wavelength of a lowest operating frequency of the first communication band.

15. The integrated wideband antenna according to claim 1, further comprising a fourth conductor patch electrically connected with the first conductor patch through a fourth shorting structure, wherein the fourth conductor patch is spaced apart from the second conductor patch at a fourth coupling interval.

16. The integrated wideband antenna according to claim 15, wherein the fourth shorting structure is composed of single or multiple conductor sheets or conductor lines, and a distance of the fourth coupling interval is between 0.001 wavelength and 0.05 wavelength of a lowest operating frequency of the first communication band.

17. The integrated wideband antenna according to claim 1, wherein the first conductor patch, the second conductor patch and the feeding conductor structure are formed on single-layer or multi-layer substrate.

18. The integrated wideband antenna according to claim 1, wherein the second connecting edge electrically connects with the first connecting edge of another set of the integrated wideband antenna, and is repeatedly connected to form an integrated wideband antenna array, and the integrated wideband antenna array is applied to a multi-input multi-output antenna system or a beamforming antenna system.

* * * * *